US006837337B2

(12) United States Patent
Thomas et al.

(10) Patent No.: US 6,837,337 B2
(45) Date of Patent: Jan. 4, 2005

(54) FALL ARREST SAFETY DEVICE

(75) Inventors: David Alan Thomas, Oakville (CA); Yohanna Wahba, Mississauga (CA)

(73) Assignee: Radian Communication Services (Canada) Limited, Oakville (CA)

( * ) Notice: Subject to any disclaimer, the term of this patent is extended or adjusted under 35 U.S.C. 154(b) by 0 days.

(21) Appl. No.: 10/435,706

(22) Filed: May 12, 2003

(65) Prior Publication Data

US 2003/0217887 A1 Nov. 27, 2003

Related U.S. Application Data

(63) Continuation of application No. PCT/CA01/01560, filed on Nov. 9, 2001.

(51) Int. Cl.[7] ..... A47L 3/04; A62B 1/20; B65H 59/16

(52) U.S. Cl. ..... 182/8; 182/5; 182/192; 188/65.2

(58) Field of Search ..... 182/3, 5, 8, 9, 182/36, 45, 191–193, 230, 231; 188/65.2, 65.3, 65.4; 248/228.1, 228.2

(56) References Cited

U.S. PATENT DOCUMENTS

| | | | | | |
|---|---|---|---|---|---|
| 3,348,632 | A | * | 10/1967 | Swager | 182/3 |
| 3,523,591 | A | * | 8/1970 | Fountain | 182/8 |
| 4,085,818 | A | * | 4/1978 | Swager | 182/8 |
| 4,193,475 | A | * | 3/1980 | Sweet et al. | 182/8 |
| 4,269,284 | A | * | 5/1981 | Swager | 182/8 |
| 4,499,966 | A | * | 2/1985 | Milne et al. | 182/3 |
| 5,156,240 | A | | 10/1992 | Ostrobrod | |
| 5,238,084 | A | * | 8/1993 | Swager | 182/8 |
| 5,265,696 | A | * | 11/1993 | Casebolt | 182/8 |
| 5,271,481 | A | * | 12/1993 | Rich | 182/3 |
| 6,161,647 | A | * | 12/2000 | Braden et al. | 182/8 |

* cited by examiner

*Primary Examiner*—Hugh B. Thompson, II
(74) *Attorney, Agent, or Firm*—Bereskin & Parr

(57) ABSTRACT

A fall arrest safety device for workers on transmission towers and the like includes a "matched" safety rail and brake trolley. The rail has a profile which includes a non-symmetrical profile portion and the trolley has a passageway of complimentary profile so that the trolley cannot be installed on the rail up-side down. A full body harness worn by a user of the device is clipped to the trolley and the trolley incorporates a brake which is spring-biassed into frictional engagement with the rail. The brake can be disengaged from the rail only by the user deliberately overriding the biassing effect.

3 Claims, 5 Drawing Sheets

22
23
10
10
20
46
48
50
UP

FALL ARREST SAFETY DEVICE

FIELD OF THE INVENTION

This invention relates generally to so-called fall arrest safety devices used by structural climbers. In particular, the invention has been devised in the context of devices intended for use by construction or maintenance personnel climbing or working at elevated levels on manmade structures such as transmission and communications towers.

BACKGROUND OF THE INVENTION

U.S. Pat. No. 5,265,696 (Casebolt) discloses an example of a prior art fall arrest device that is designed to work in conjunction with a fixed cable on the structure being climbed. The worker wears a safety belt or harness that clips on to the safety device and the device incorporates a friction plate or shoe that grips onto the cable. The user can manually release the friction plate or shoe in order to be able to move up or down relative to the fixed cable.

LeBlanc Ltd. has been in the business of engineering, manufacturing and installing transmission and broadcast towers since 1962. The erection of these structures, with heights up to 2000 feet, requires extensive climbing while working on the tower. What is needed is the development of an effective and efficient fall protection system.

Years ago, LeBlanc was instrumental in the creation of Industry Canada's workplace safety program for work on "aerial transmission towers". For a long time LeBlanc has instituted and enforced a safety program demanding that all riggers working on towers utilize a fall protection system 100% of the time. This not only applies during construction of the tower, but also in the follow-up servicing and maintenance of the tower, lights, antennas and lines that are an integral aspect of the structure. Because the average tower has a "life expectancy" of over 50 years, there is ongoing maintenance and antenna servicing which will take place on each site.

LeBlanc is the largest tower company in Canada, with offices in 7 regions and over 400 employees, so its interest is in a better fall protection system not only for sale to the marketplace, but primarily for the safety of its own employees.

A fall protection system is what tower climbers (or riggers) count on to be their "life saver" in the event that they slip or lose their balance while working on towers.

In 1998 there was a fatality on a tower where it was later found that the cause of the accident was that the safety device was installed by the rigger "up-side down". This resulted in the arrest mechanism not being able to engage. Though there had been other accidents where the trolley was installed incorrectly, this was the impetus for a safer and better system.

Though the worker who was killed did not work for LeBlanc, it was felt that with hundreds of riggers using the same fall arrest mechanism as this individual, it was imperative that a system be designed which would better protect LeBlanc's workers.

The fall arrest device disclosed herein is a radical change from previous iterations, and one that has undergone countless tests, including those by The Canadian Standards Association, resulting in its safety accreditation. Among the benefits of this product is that it can not be installed "up-side down".

The device includes a safety rail which is intended to be fixed to a structure. Slidably mounted on the safety rail is a safety trolley, which connects to the climbers full-body harness. This allows the rigger to climb up and down the structure safely. In the event that the climber slips or transfers their weight to the trolley, the trolley immediately locks onto the rail arresting the fall.

The design profile of the rail features a "T" shape with one side of greater thickness than the other, with the trolley having a mirror profile. This guarantees that the fall arrest feature will always be in the right position. Though seemingly quite simple, this design is the only fall arrest rail system to incorporate this feature.

Among the other benefits of this product is that because or its "ease of operation", more riggers are apt to use this safety gear. Much like automobile seat belts in their early years, improvements in comfort and ease of operation results in a higher percentage of drivers using the seat belt.

This unique advancement in design is a step forward from previous systems and we would like to consider the development and use of this safety system as proprietary.

SUMMARY OF THE INVENTION

A fall arrest safety device comprising, in combination, a safety trolley and a rail. The safety trolley has provision to permit attachment thereto of a safety belt or safety harness worn by a user of the device and the rail is adapted to be fixed in a generally upright orientation on a structure on which the user is climbing or working. The rail has a profile which includes a non-symmetrical profile portion and the trolley has an upper end and a lower end and defines a passageway of complimentary profile for receiving the rail, so that the trolley can be installed on the rail only with the upper end of the trolley uppermost. The trolley incorporates a brake which frictionally engages the rail for arresting movement of the trolley downwardly with respect to the rail, and means biassing the brake into frictional engagement with the rail. The brake can be disengaged from the rail only by a deliberate act of the user against the effect of the biassing means.

In summary, the invention provides a fall arrest device that cannot be installed "up-side down" on the rail. Accordingly, the brake will always operate to prevent downward movement of the trolley with respect with the rail and accidents due to the safety device being incorrectly installed are avoided.

Preferably, the asymmetrical portion of the profile of the rail is T-shaped with one side of the top limb of the T thicker than the other, and the passageway in the trolley is of complimentary shape.

The rail preferably is a rigid rail that can be permanently affixed to a ladder used by the worker, or directly to the tower or other structure. Alternatively, it is possible that a flexible rail or the like could be provided. Asymmetrical rail profiles other than T-shaped may be used.

BRIEF DESCRIPTION OF DRAWINGS

In order that the invention may be more clearly understood, reference will now be made to the accompanying drawings which illustrate a particular preferred embodiment of the invention only, and in which.

DESCRIPTION OF PREFERRED EMBODIMENT

Figure 4:
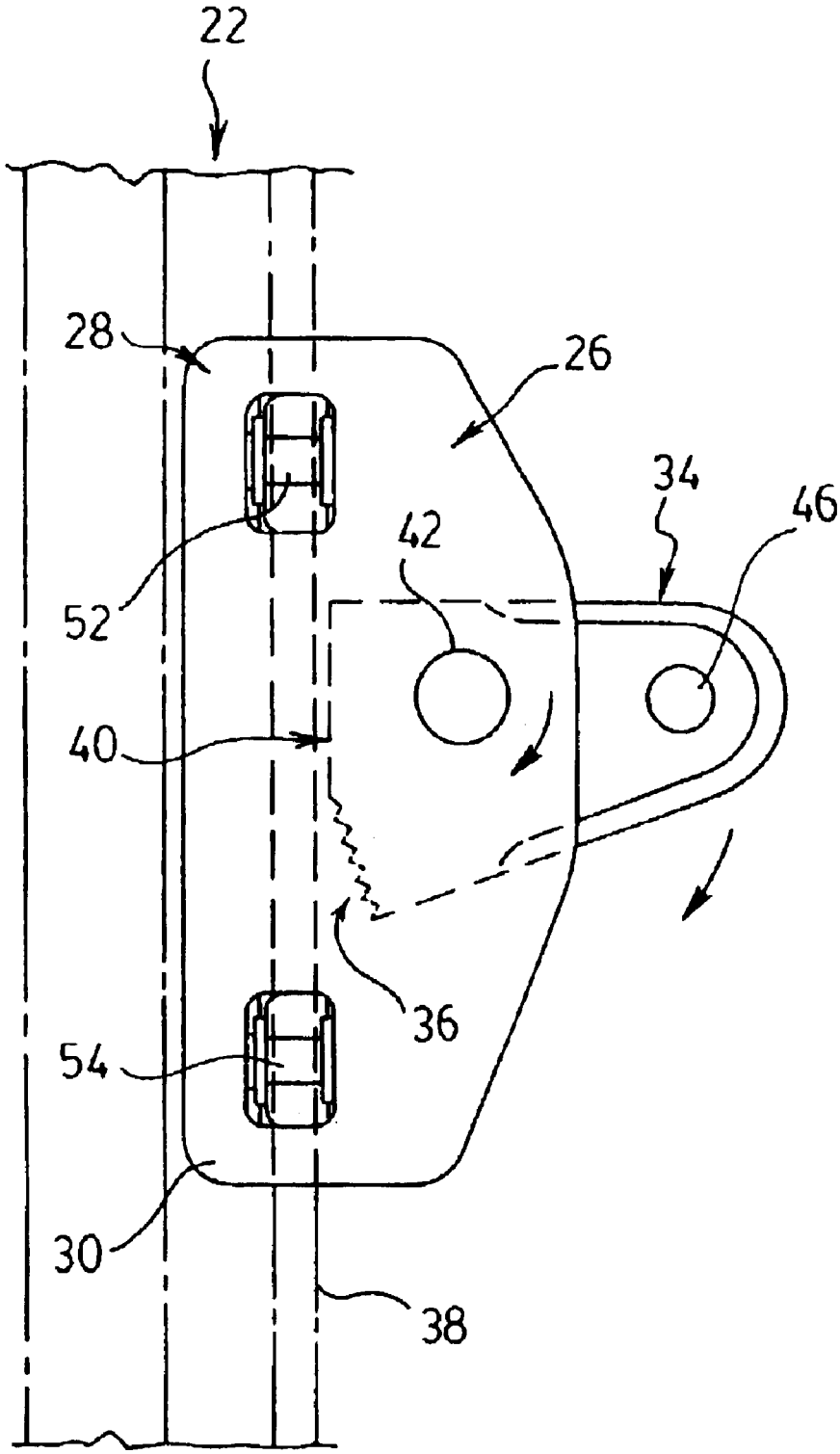
FIG. 4 is a view similar to FIG. 1 but showing the internal brake of the trolley.
Figure 5:
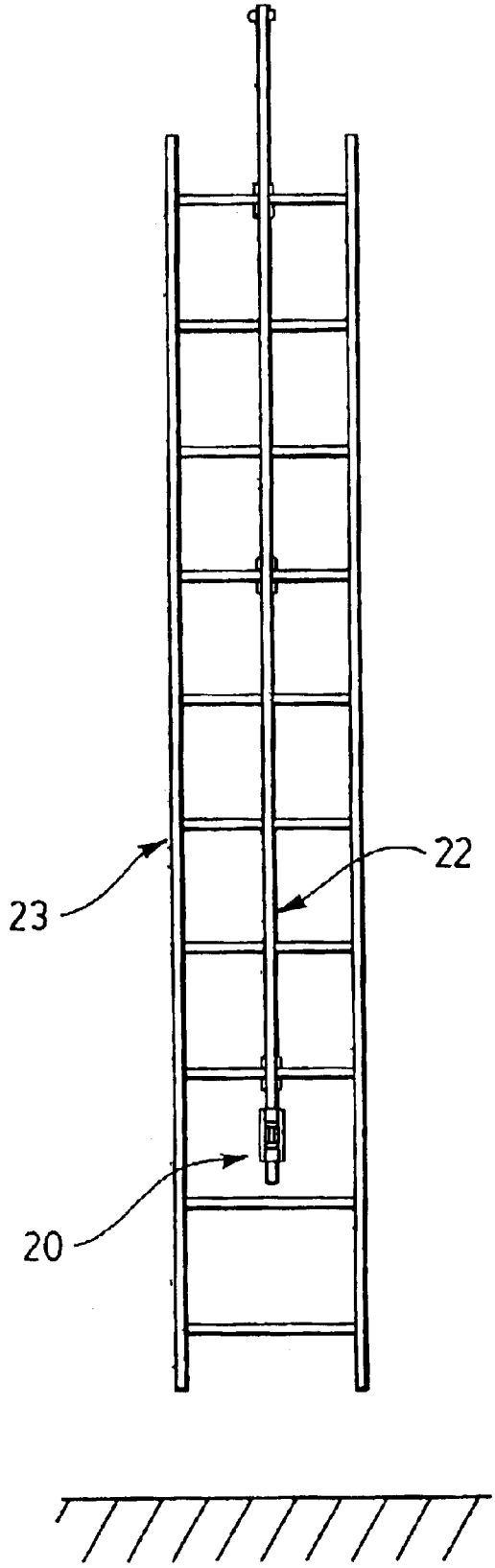
FIG. 5 is an elevational view showing the rail installed on a ladder.
Figures 6, 7, 8, 9:
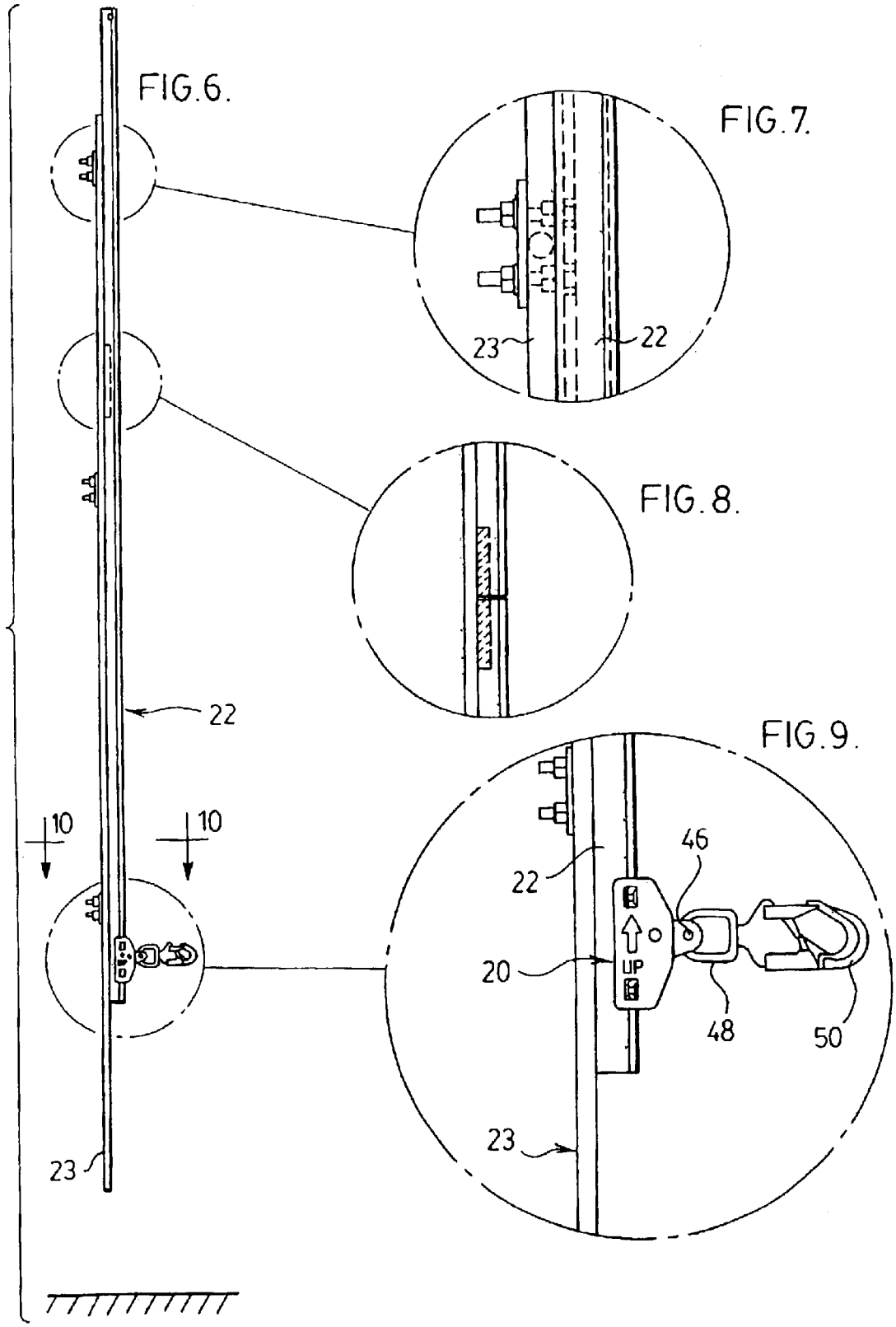
FIG. 6 is a side elevational view corresponding to FIG. 5.
FIGS. 7, 8 and 9 are enlarged views of the portions of FIG. 6 that are correspondingly circled; and, FIG. 10 is a sectional view on line A—A of FIG. 6.
Figure 10:
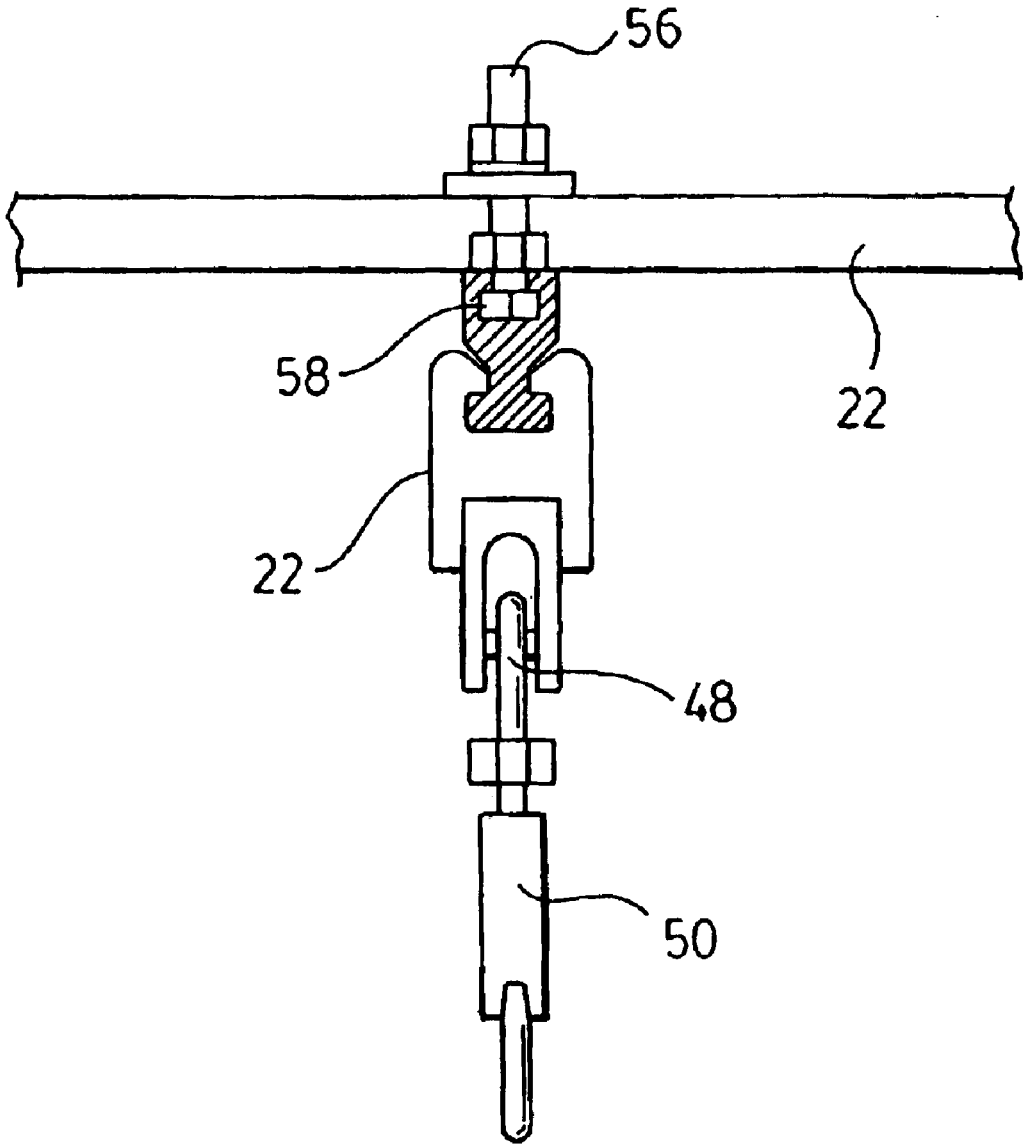

The fall arrest safety device of the invention comprises a safety trolley and a "matching" rail. In the drawings, the trolley is indicated by reference numeral 20 and best shown in FIGS. 1 to 4. The rail is shown in FIGS. 5 and 6 at 22 installed in a generally upright orientation on a ladder 23 that is intended to support a user of the safety device. The ladder may itself be incorporated in or mounted on a transmission tower or other structure on which the user is climbing or working. Alternatively, the rail may be mounted directly to the tower or other structure.

Figure 2:
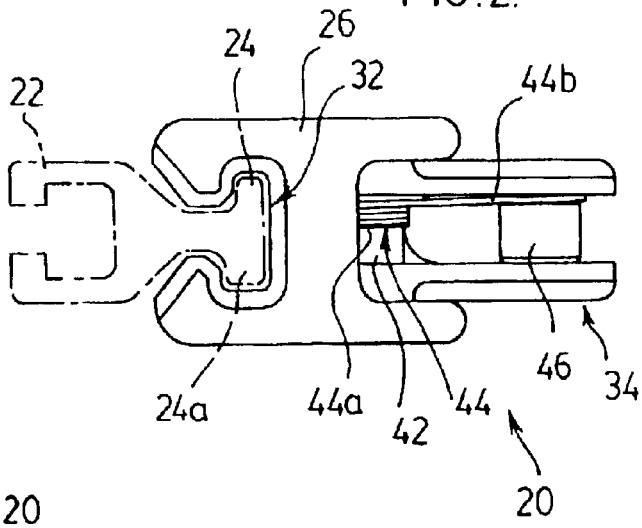
FIGS. 2 and 3 are top plan and left side elevational views respectively corresponding to FIG. 1.
Figure 3:
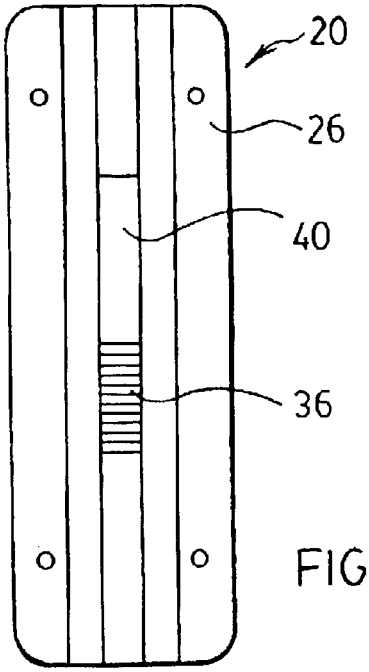

FIG. 2 shows the profile (cross-sectional) shape of the rail 22 in ghost outline and it will be seen that the profile includes a non-symmetrical profile portion 24, which in this case is generally T-shaped but with one side of the top limb of the T thicker than the other side. The thicker side is denoted 24*a* in FIG. 2 and is shown at the bottom of the figure.

The safety trolley 20 has a body 26 which has an upper end 28 and a lower end 30. As shown in FIG. 2, the body is clearly marked with an arrow and the word "UP" to indicate proper orientation of the trolley on the rail.

Extending from top to bottom of the body 26 is a passageway 32 that has a profile shape complimentary to the shape of the non-symmetrical profile portion 24 of the rail 22. As such, the trolley 20 can be installed only one way around on the rail. Assuming of course that the rail has bene correctly installed, the trolley 20 will fit on the rail only with its upper end 28 at the top.

The trolley incorporates a brake for frictionally engaging the rail 22. In the illustrated embodiment, the brake comprises a so-called fall arrest lever 34 that is received in a recess 26*a* in body 26 at the side remote from passageway 32. The recess communicates with the passageway internally of the body and the lever has an inner end that includes a serrated braking surface 36 portion (FIG. 4) for frictionally engaging an end face 38 of the rail 22 and arresting movement of the trolley 20 longitudinally of the rail. Immediately above the serrated surface portion 36 is a plain and flat surface portion 40.

The two surface portions 36 and 40 are disposed at a slight angle with respect to one another and the lever 34 is pivotally coupled to the trolley body 26 by a pivot pin 42 so that the lever can turn through a relatively small angular amount with respect to body 26 to bring either the plain surface portion 40 or the serrated portion 36 of the lever into contact with the rail 22. As seen in FIG. 4, lever 34 has pivoted upwardly at its outer end so that the plain surface portion 40 of the lever is in contact with the rail. In this position of the lever, the trolley can slide longitudinally of the rail, but with some frictional resistance, i.e. the brake is essentially "off". If the outer end of lever 34 is moved down, the serrated surface portion 36 engages and "bites" into the end face 38 of rail 22. The brake is then "on", and the trolley is locked to the rail.

Referring back to FIG. 3, a coil spring 44 is mounted on pivot pin 40 for biassing lever 34 downwardly at its outer end and into the "brake on" position, with the serrated surface portion 36 in engagement with rail 22. Outwardly of pivot pin 40, lever 34 is slotted or bifurcated and a so-called lanyard pin 46 is provided between the two bifurcated portions of the lever. One end portion 44*a* of spring 44 extends upwardly from pivot pin 42 and engages in a recess (not visible) in the body 26 of the trolley 20. The other end 44*b* of spring 44 extends above and is curved slightly downwardly over lanyard pin 46 so as to in effect press down on the lanyard pin and bias lever 34 downwardly at its outer end. In other words, the brake of trolley 20 is biassed "on" but can be released by lifting the outer end of lever 34.

FIG. 9 shows a swivel hook 48 fitted to the lanyard pin 46 (the pin is removable for that purpose) and the swivel hook carries a latch or clip 50 that can be engaged with a safety belt or body harness worn by a user of the device. It can be appreciated from this view that, when clipped to the device in this way, the user is safely restrained against falling. If he or she should slip or fall, the weight of the user is applied downwardly on lever the outer end of 34, which has the effect of pressing the serrated surface portion 36 of the lever even more firmly against the rail, so that the user's weight is effectively added to the braking effect. If the user needs to climb, the harness and hook 50 will be pulled upwardly with respect to the trolley 20 so that the brake is released and the trolley can move up on the rail 22. Should the user slip or fall at this time, his or her weight will be exerted downwardly on the outer end of lever 34, applying the brake.

Figure 1:
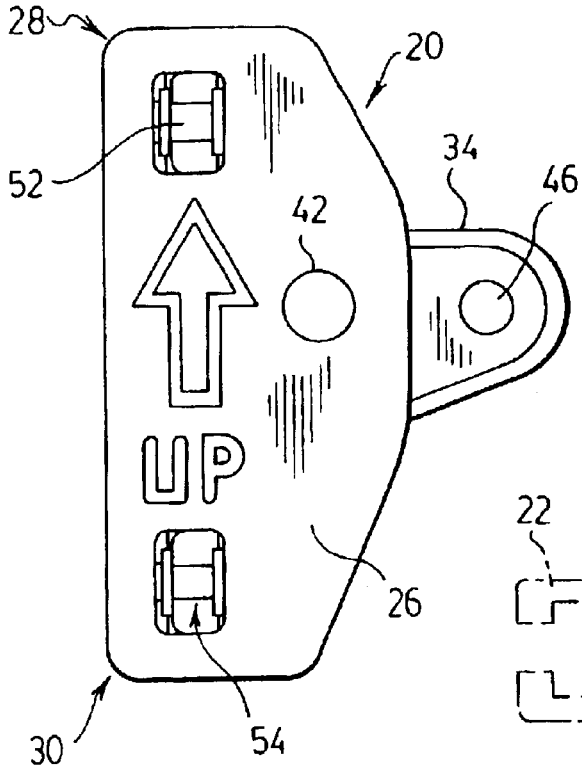
FIG. 1 is a side elevational view of the trolley.

FIGS. 1 and 4 show upper and lower rollers 52 and 54 that are incorporated into the body 26 of the trolley 20 and that are designed to run on the outer edge of the relevant side of the T-shaped portion of the rail profile. A similar pair of rollers is provided at the opposite side of the body but is not visible in the drawings.

FIGS. 6 to 10 illustrate the manner in which rail 22 is clamped to the ladder or other structure using clamping bolts (one of which is indicated at 56 in FIG. 10) positioned with their heads (58) in what is in effect an undercut channel extending longitudinally of the inner face of rail 22 (opposite the asymmetrical T-shaped portion 24).

In summary, the invention provides a fall arrest safety device comprising a safety rail and brake trolley which are "matched" so that the trolley cannot be fitted to a safety rail up-side down and the device will always operate in the correct direction, assuming of course that the rail itself is correctly installed. The device will always "fail safe" in the sense that the weight of a user will tend to increase the braking force between the trolley and the rail. At the same time, the user can move up with respect to the rail simply by pulling up on the lever 34.

It will of course be understood that the preceding description relates to a particular preferred embodiment of the invention only and that modifications are possible, some of which have been indicated and others of which will be apparent to a person skilled in the art. For example, while it is believed preferable to use the particular asymmetrical T-shaped rail profile disclosed, other asymmetrical profiles would work within the broad scope of the invention.

Other forms of braking arrangement could be used. For example, a brake shoe or friction plate could engage the rail. The brake could be actuated differently from the pivoted lever arrangement shown. Also, the arrangement for releasing the brake could be different. For example, there could be a manual disengagement arrangement that would be separate from the harness attachment point.

We claim:

1. A fall arrest safety device comprising, in combination: a safety trolley having means to permit attachment thereto of a safety belt or safety harness worn by a user of the device;

and a rail adapted to be fixed in a generally upright orientation on a structure on which the user is climbing or working; the rail having a profile which includes a non-symmetrical profile portion and the trolley defining a passageway of complimentary profile that matingly receives said non-symmetrical profile portion when the trolley is in a normal orientation of use with an upper end of the trolley above the lower end of the trolley, said non-symmetrical profile portion being of a shape that prevents installation of the trolley on the rail when the trolley is in a reverse orientation with the lower end of the trolley above the upper end of the trolley; wherein the trolley incorporates a brake which frictionally engages the rail for arresting movement of the trolley downwardly with respect to the rail, and means biassing the brake into frictional engagement with the rail, the brake being disengageable from the rail only by a deliberate act of the user against the effect of the biassing means.

2. The device as claimed in claim 1, wherein the non-symmetrical portion of the profile of the rail is T-shaped with one side of a planar top limb of the T having a thickness greater than the other side of the top limb.

3. The device as claimed in claim 1 or 2, wherein the rail is a rigid rail that can be permanently affixed to a ladder or other structure.

* * * * *